US007792445B2

(12) United States Patent
Sone et al.

(10) Patent No.: US 7,792,445 B2
(45) Date of Patent: Sep. 7, 2010

(54) DRIVE DETECTION DEVICE FOR FIXING DEVICE

(75) Inventors: Toshihiro Sone, Yokohama (JP); Osamu Takagi, Chofu (JP); Satoshi Kinouchi, Shinjuku-ku (JP); Yoshinori Tsueda, Fuji (JP); Tetsuo Kitamura, Mishima (JP); Hiroshi Nakayama, Mishima (JP); Yohei Doi, Mishima (JP); Kazuhiko Kikuchi, Yokohama (JP); Masanori Takai, Izunokuni (JP); Toyoyasu Kusaka, Izu (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 474 days.

(21) Appl. No.: 11/947,390

(22) Filed: Nov. 29, 2007

(65) Prior Publication Data

US 2008/0131159 A1 Jun. 5, 2008

Related U.S. Application Data

(60) Provisional application No. 60/867,916, filed on Nov. 30, 2006.

(51) Int. Cl.
*G03G 15/20* (2006.01)

(52) U.S. Cl. ..... 399/67; 399/33; 399/122; 399/333

(58) Field of Classification Search ..... 399/33, 399/67, 69, 122, 328, 330, 333; 347/153, 347/E13.01; 250/338.1, 340
See application file for complete search history.

(56) References Cited

U.S. PATENT DOCUMENTS

| | | | | |
|---|---|---|---|---|
| 5,811,759 | A * | 9/1998 | Kosagi et al. | 219/216 |
| 6,397,021 | B2 * | 5/2002 | Hayashi et al. | 399/69 |
| 6,408,146 | B1 * | 6/2002 | Nagano | 399/67 |
| 2006/0210292 | A1 * | 9/2006 | Kinouchi et al. | 399/69 |

FOREIGN PATENT DOCUMENTS

| | | |
|---|---|---|
| JP | 2006-026733 | 2/2006 |

* cited by examiner

*Primary Examiner*—David P Porta
*Assistant Examiner*—Benjamin Schmitt
(74) *Attorney, Agent, or Firm*—Turocy & Watson, LLP

(57) ABSTRACT

In a drive detection device for a fixing device according to an embodiment of the present invention, a non-paper passing area of a heat roller is formed by a surface where a metal conductive layer is exposed and a surface where a silicon rubber layer is exposed. The drive detection device has an infrared temperature sensor that detects the temperature of the non-paper passing area. When a detection result of the infrared temperature sensor is fluctuated a fixed amount or more in a predetermined time, the drive detection device determines that the heat roller is rotating. Otherwise, the drive detection device determines that the heat roller is not rotating.

20 Claims, 6 Drawing Sheets

INFRARED EMISSIVITY MEASUREMENT

DRIVE DETECTION DEVICE FOR FIXING DEVICE

CROSS REFERENCE TO RELATED APPLICATION

This invention is based upon and claims the benefit of priority from prior U.S. Patent Application 60/867,916 filed on Nov. 30, 2006, the entire contents of which are incorporated herein by reference.

BACKGROUND OF THE INVENTION

1. Field of the Invention

The present invention relates to a drive detection device for a fixing device mounted on image forming apparatuses such as a copying machine, a printer, and a facsimile, and, more particular to a drive detection device for a fixing device employing an induction heating system.

2. Description of the Background

In recent years, there is a fixing device of an induction heating system used in image forming apparatuses such as a copying machine and a printer of an electrophotographic system. The fixing device includes a fixing member in which a metal layer having a small heat capacity is provided on the surface of an elastic layer thereof. When the metal layer is induction-heated in a state in which the fixing member is stopped, there is a risk that the fixing member overheats. Therefore, for example, JP-A-2006-26733 discloses a fixing device in which a rotation detection pattern formed by a thin-layer metal piece is provided in a fixing member. When the fixing member is rotated, the fixing device detects fluctuation in an induction load of an exciting coil periodically generated by the thin-film metal piece to thereby detect the rotation of the fixing member.

However, in the apparatus in the past, a new member, i.e., the thin-layer metal piece is necessary in the common fixing member. During the detection of the rotation, when a driving frequency of the exciting coil that performs induction heating fluctuates, there are fears that the induction load that should be detected also fluctuates, and accurate and quick rotation detection is not realized.

Therefore, there is a demand for development of a drive detection device for a fixing device that accurately and quickly detects a rotation state of a heat generating member, which has a metal layer on the surface of an elastic layer, to thereby prevent overheat of the heat generating member, which is caused by failure of detection or a delay in detection of the rotation state of the heat generating member, and realize improvement of safety.

SUMMARY OF THE INVENTION

According to an aspect of the present invention, there is provided a drive detection device for a fixing device that quickly and accurately detects a rotation state of a heat generating member without providing a new member in the heat generating member to thereby prevent overheat of the heat generating member due to failure of detection or a delay in detection of the rotation state and improve safety.

According to an embodiment of the present invention, a drive detection device for a fixing device includes a heat generating member that has a metal layer to be induction-heated, the entire surface of the metal layer being coated with a coating layer in a paper passing area, and has, in a non-paper passing area, a surface where the metal layer is exposed and a surface where the coating layer is exposed, an induction current generating device that induction-heats the metal layer, a driving source that rotates the heat generating member, an infrared temperature sensor that detects the surface temperature in the non-paper passing area of the heat generating member, and a control unit that determines a rotation state of the heat generating member according to a detection result of the infrared temperature sensor.

DESCRIPTION OF THE EMBODIMENTS

Figure 1:
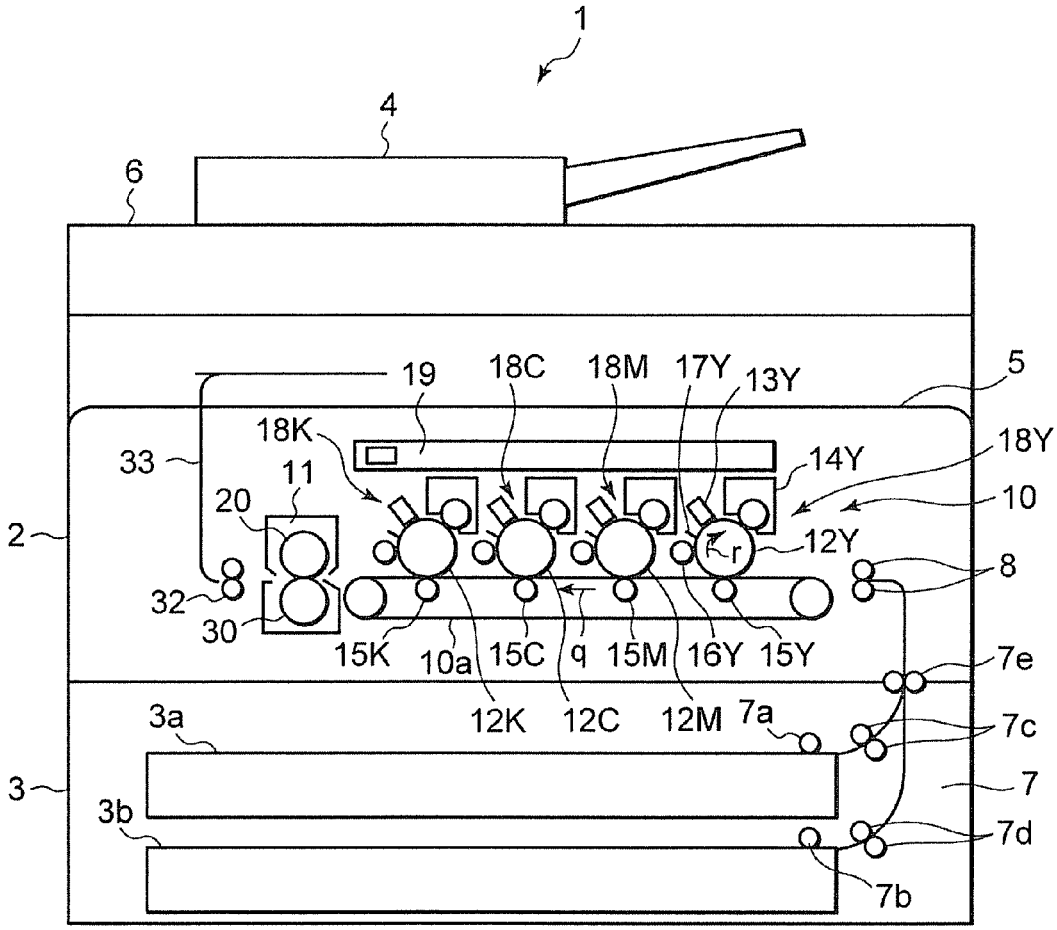
FIG. 1 is a schematic diagram showing an image forming apparatus according to an embodiment of the present invention.

An embodiment of the present invention will be hereinafter explained in detail with reference to the accompanying drawings. FIG. 1 is a schematic diagram showing an image forming apparatus 1 according to this embodiment. The image forming apparatus 1 includes a scanner unit 6 that scans an original document and a paper feeding unit 3 that feeds sheet paper P as a recording medium to a printer unit 2 that forms an image. The scanner unit 6 converts image information scanned from the original document supplied by an automatic document feeder 4, which is provided on an upper surface thereof, into an analog signal.

The printer unit 2 includes an image forming unit 10 in which image forming stations 18Y, 18M, 18C, and 18K for respective colors of yellow (Y), magenta (M), cyan (C) and black (K) are arranged in tandem along a transfer belt 10*a* rotated in an arrow "q" direction. The image forming unit 10 further includes a laser exposing device 19 that irradiates laser beams corresponding to image information to photoconductive drums 12Y, 12M, 12C, and 12K of the image forming stations 18Y, 18M, 18C, and 18K for the respective colors. The printer unit 2 further includes a fixing device 11, a paper discharge roller 32, and a paper discharging and conveying path 33 that conveys the sheet paper P after fixing to a paper discharge unit 5.

In the image forming station 18Y for yellow (Y) of the image forming unit 10, a charging device 13Y, a developing device 14Y, a transfer roller 15Y, a cleaner 16Y, and a charge removing device 17Y are arranged around the photoconductive drum 12Y that rotates in an arrow "r" direction. The image forming stations 18M, 18C, and 18K for the respective colors of magenta (M), cyan (C), and black (K) have the structure same as that of the image forming station 18Y for yellow (Y).

The paper feeding unit 3 includes first and second paper feeding cassettes 3*a* and 3*b*. In a conveying path 7 for the sheet paper P extending from the paper feeding cassettes 3*a* and 3*b* to the image forming unit 10, pickup rollers 7*a* and 7*b* that pickup the sheet paper P from the paper feeding cassettes 3*a* and 3*b*, separating and conveying rollers 7*c* and 7*d*, a conveying roller 7*e*, and a resist roller 8 are provided.

When print operation is started, in the image forming station 18Y for yellow (Y) of the printer unit 2, the photoconductive drum 12Y is rotated in the arrow "r" direction and uniformly charged by the charging device 13Y. Exposure light corresponding to yellow image information scanned by the scanner unit 6 is irradiated on the photoconductive drum 12Y by the laser exposure device 19 and an electrostatic latent image is formed thereon. Thereafter, a toner is supplied to the photoconductive drum 12Y by the developing device 14Y and a yellow (Y) toner image is formed thereon. In the position of the transfer roller 15, this yellow (Y) toner image is transferred onto the sheet paper P conveyed in the arrow "q" direction on the transfer belt 10*a*. After the transfer of the toner image is finished, a residual toner is removed from the photoconductive drum 12Y by the cleaner 16Y, and electric charge on the surface of the photoconductive drum 12Y is removed by the charge removing device 17. In this way, the photoconductive drum 12Y is prepared for the next printing.

Toner images are formed in the image forming stations 18M, 18C, and 18K for the respective colors of magenta (M), cyan (C), and black (K) in the same manner as the image formation in the image forming station 18Y for yellow (Y). In the positions of the respective transfer rollers 15M, 15C, and 15K, the toner images of the respective colors formed in the image forming stations 18M, 18C, and 18K are sequentially transferred onto the sheet paper P on which the yellow (Y) toner image is formed. A color toner image is formed on the sheet paper P in this way. The sheet paper P is heated and pressed to have the color toner image fixed thereon by the fixing device 11 to complete a print image. Then, the sheet paper P is discharged to the paper discharge unit 5.

Figure 2:
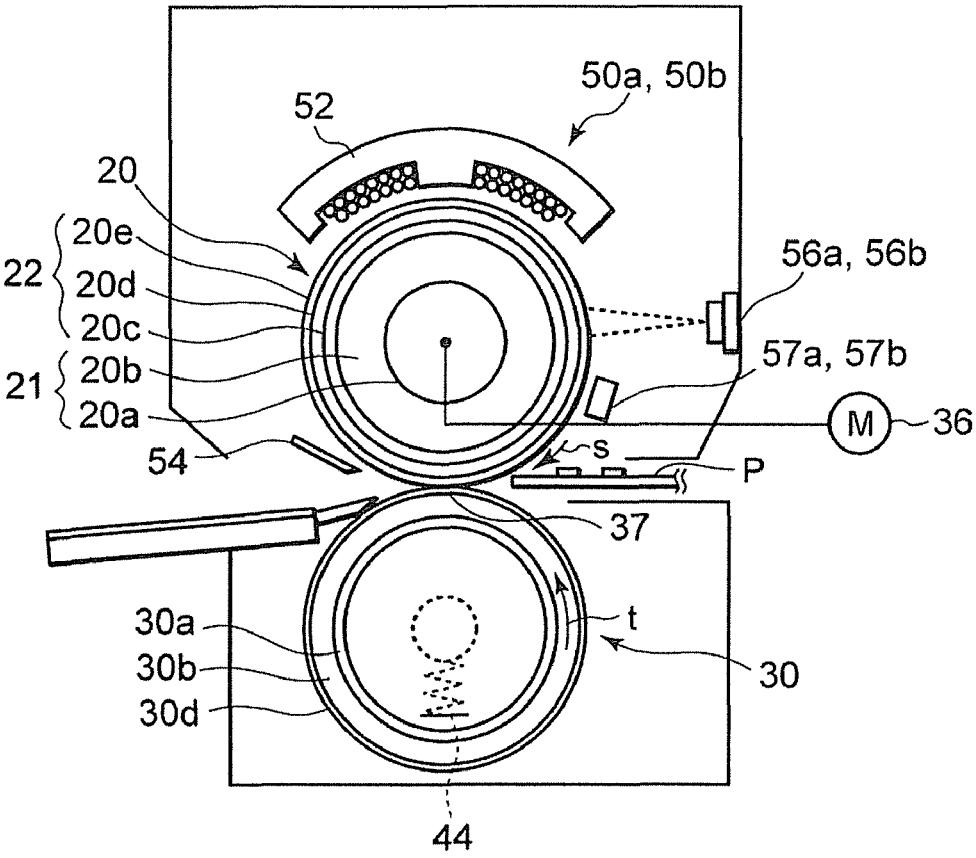
FIG. 2 is a schematic diagram of a fixing device according to the embodiment viewed from an axial direction thereof.

The fixing device 11 is explained. FIG. 2 is a schematic diagram of the fixing device 11 viewed from an axial direction thereof. The fixing device 11 includes a heat roller 20 as a heat generating member and a press roller 30 as an opposed member. Diameters of the heat roller 20 and the press roller 30 are set to 50 mm respectively. The press roller 30 is pressed and brought into contact with the heat roller 20 by a pressing mechanism including a spring 44. Consequently, a nip 37 having a fixed width is formed between the heat roller 20 and the press roller 30.

The heat roller 20 is rotated in an arrow "s" direction by a fixing motor 36 as a driving source. The press roller 30 is rotated in an arrow "t" direction following the heat roller 20. The heat roller 20 and the press roller 30 nip the sheet paper P in a nip 37 and convey the sheet paper P in the direction of the paper discharge roller 32. When the sheet paper P passes through such a nip 37 between the heat roller 20 and the press roller 30, a toner image on the sheet paper P is heated, pressed, and fixed. However, a driving mechanism and a pressing mechanism for the heat roller 20 and the press roller 30 are not limited. For example, the press roller 30 may be rotated by a fixing motor to rotate the heat roller 20 following the press roller 30. Driving mechanisms may be provided in both the heat roller 20 and the press roller 30. A pressure may be applied from the heat roller 20 to the press roller 30.

The heat roller 20 includes an elastic roller 21 and a metal belt 22. The elastic roller 21 includes a metal shaft 20*a* made of, for example, iron (Fe) or aluminum and a foam silicon rubber layer 20*b* that is an elastic layer arranged around the metal shaft 20*a* and has the thickness of, for example, 10 mm. The foam silicon rubber layer 20*b* is made of an open-cell microcellular foam that has heat resistance and has an average cell diameter of, for example, about 150 microns.

The metal belt 22 has a silicon rubber layer 20*d* as a coating layer having the thickness of, for example, 200 μm on the surface of a metal conductive layer 20*c* as a metal layer made of, for example, nickel (Ni) and having the thickness of 40 μm. A surface layer 20*e* is stacked on the surface of the silicon rubber layer 20*d*. The surface layer 20*e* is made of, for example, fluorine resin (PFA or PTFE (poly-tetrafluoroethylene) or a mixture of PFA and PTFE). The metal layer may be made of stainless steel, aluminum, a composite of stainless steel and aluminum, or the like instead of nickel.

In the elastic roller 21, the metal shaft 20*a* and the foam silicon rubber layer 20*b* are fixed to each other. In the metal belt 22, the metal conductive layer 20*c* and the silicon rubber layer 20*d* are fixed to each other and the silicon rubber layer 20*d* and the surface layer 20*e* are fixed to each other. However, foam silicon rubber layer 20*b* and the metal conductive layer 20*c* are not adhered.

For example, at the room temperature (30° C.), an outer diameter of the elastic roller 21 is smaller than an inner diameter of the metal belt 22 by, for example, about 0.2 mm to 0.7 mm. Therefore, since the metal belt 22 is not bonded and fixed to the elastic roller 21, the metal belt 22 is slidable with respect to the elastic roller 21. When the metal belt 22 has exhausted a life, the metal belt 22 is replaceable. The elastic roller 21 is thermally expanded by heating. For example, when the surface of the heat roller 20 is left untouched in a state of fixable temperature of 160° C., the foam silicon rubber layer 20*b* gradually expands. In a state in which the foam silicon rubber layer 20*b* expands in this way, the outer diameter of the elastic roller 21 is larger than the inner diameter of the metal belt 22 by, for example, about 0.2 mm to 0.5 mm. Consequently, the metal belt 22 fits in the elastic roller 21 in a state in which the elastic roller 21 is tightened. The structure of the heat roller 20 is not limited. The foam silicon rubber layer 20*b* and the metal conductive layer 20*c* may be bonded and integrally formed.

Figure 3:
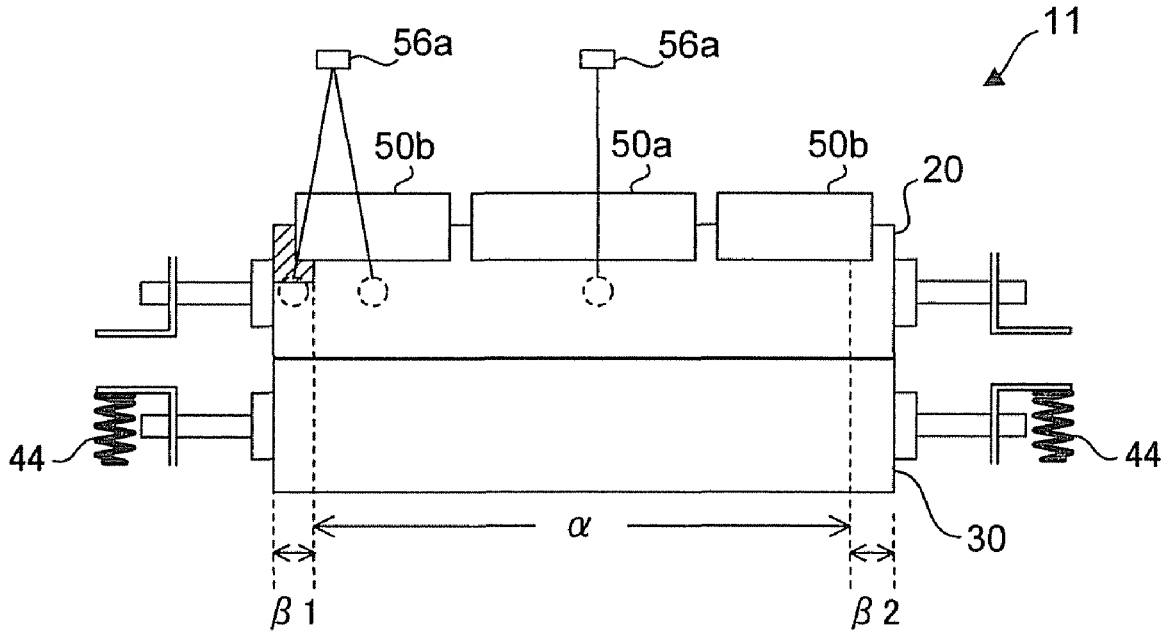
FIG. 3 is a schematic explanatory diagram of the fixing device according to the embodiment viewed from a direction parallel to a shaft.
Figure 4:
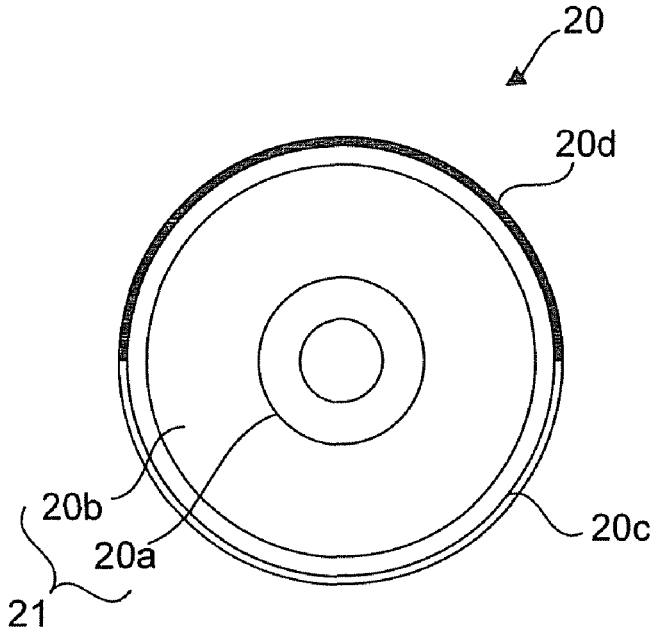
FIG. 4 is a sectional view showing one side of non-paper passing areas of a heat roller according to the embodiment.

As shown in FIG. 3, the heat roller 20 has non-paper passing areas (β1) and (β2) on both sides of a paper passing area (α). In the paper passing area (α) of the heat roller 20, the metal belt 22 is formed by coating the entire surface of the metal conductive layer 20*c* with the silicon rubber layer 20*d* and stacking the surface layer 20*e* on the silicon rubber layer 20*d*. One side (β1) of the non-paper passing areas of the heat roller 20 includes, as shown in FIG. 4, a surface where the metal conductive layer 20*c* is exposed and a surface where the silicon rubber layer 20*d* is exposed. In other words, in a rotating direction of the heat roller 20, the metal conductive layer 20*c* is exposed in half the entire length of the peripheral surface of the heat roller 20. The silicon rubber layer 20*d* is exposed in the remaining half. The surface layer 20*e* is not stacked on the surface of the metal conductive layer 20*c* and the surface of the silicon rubber layer 20*d* on one side (β1) of the non-paper passing areas.

Nickel (Ni) of the surface of the metal conductive layer 20*c* on one side (β1) of the non-paper passing areas is mirror finished such that surface roughness Ra defined by JISB0601 is equal to or smaller than 6.3. Consequently, even if surface temperature is the same over the entire periphery of one side (β1) of the non-paper passing areas, infrared emissivity is different on the surface of the metal conductive layer 20*c* and the surface of the silicon rubber layer 20*d*. In other words, the infrared emissivity on the surface of the mirror finished metal conductive layer 20*c* is low compared with the infrared emissivity on the surface of the silicon rubber layer 20*d* that is equal to or higher than 0.9.

Figure 5:
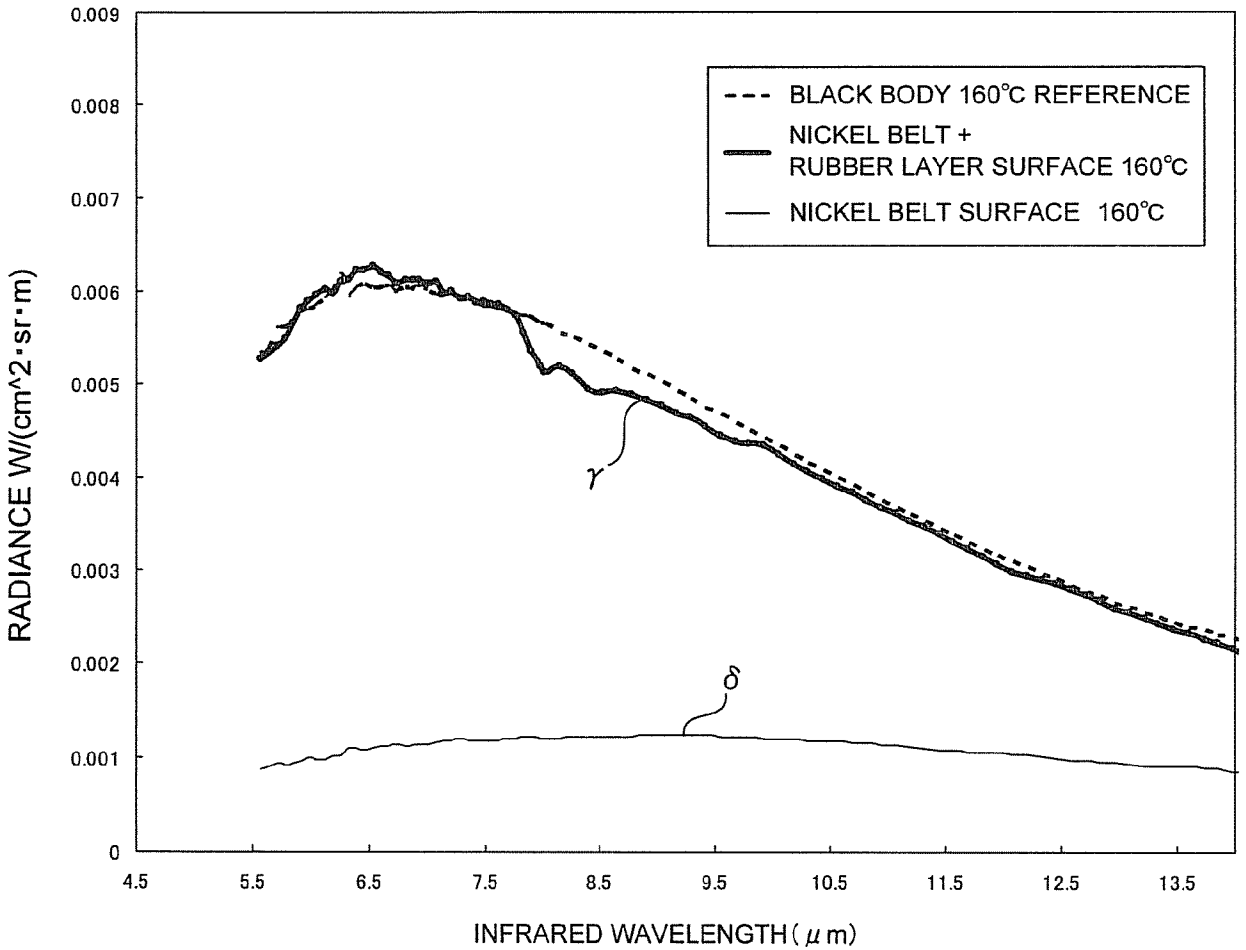
FIG. 5 is a graph showing infrared radiant energy on a metal conductive layer surface and a silicon rubber layer surface on one side (β1) of the non-paper passing areas at the time when the surface temperature of the heat roller is 160° C. according to the embodiment.

For example, when the surface temperature on one side (β1) of the non-paper passing areas is 160° C., a result shown in FIG. 5 is obtained by measuring infrared radiant energy on the surface of the metal conductive layer 20*c* and the surface of the silicon rubber layer 20*d* in Inframatrics, Inc. Model 600L (infrared temperature distribution detector). In an infrared wavelength region (5.5 μm to 12.5 μm), infrared radiant energy indicated by a solid line γ in FIG. 5 is emitted from the surface of the silicon rubber layer 20*d*. On the other hand, infrared radiant energy emitted from the surface of the metal conducive layer 20*c* is equal to or lower than 0.002 RADIANCE W/(cm^2·sr·μm) as indicated by a solid line δ in FIG. 5.

Consequently, even if the surface temperature on one side (β1) of the non-paper passing areas is the same over the entire periphery, a detection result obtained by detecting the temperature with an infrared temperature sensor is different on the surface of the metal conductive layer 20*c* and the surface of the silicon rubber layer 20*d*. Therefore, when the heat roller 20 is rotating, a detection output of the infrared temperature sensor alternately fluctuates on the surface where the metal conductive layer 20*c* is exposed and the surface where the silicon rubber layer 20*d* is exposed. As a result, the infrared temperature sensor can detect a rotation state of the heat roller 20 according to the fluctuation in the output at the time when the temperature on one side (β1) of the non-paper passing area is detected.

The press roller 30 is formed by covering, for example, a silicon rubber layer 30*b* and a surface layer 30*d* around a hollow metal shaft 30*a*. The thickness of the silicon rubber layer 30*b* of the press roller 30 is not limited. However, for example, when a heating member such as a lamp is provided in a hollow portion of the metal shaft 30*a*, it is preferable to set, taking into account heat conductivity, the thickness to about 0.2 mm to 3 mm such that a temperature difference between an inner side and an outer side of the silicon rubber layer 30*b* is reduced.

On the outer circumference of the heat roller 20, a peeling pawl 54, first and second induction current generating coils 50*a* and 50*b* as induction current generating devices, first and second thermistors 56*a* and 56*b* as infrared temperature sensors that are not in contact with the heat roller 20, and first and second thermostats 57*a* and 57*b* are provided. The peeling pawl 54 prevents the sheet paper P after fixing from twining around the heat roller 20. The peeling pawl 54 may be a contact type or a non-contact type.

The first and second induction current generating coils 50*a* and 50*b* are provided on the outer circumference of the heat roller 20 via a predetermined gap and cause the metal layer 20*c* of the heat roller 20 to generate heat. The first induction current generating coil 50*a* causes a center area of the heat roller 20 to generate heat and the second induction current generating coil 50*b* causes areas on both sides of the heat roller 20 to generate heat.

The first and second induction current generating coils 50*a* and 50*b* are alternately switched to output electric powers. The electric powers are adjustable, for example, between 200 W and 1500 W. The first and second induction current generating coils 50*a* and 50*b* may be capable of simultaneously outputting electric powers. When the first and second induction current generating coils 50*a* and 50*b* simultaneously output powers, it is possible to change output values of the first induction current generating coil 50*a* and the second induction current generating coil 50*b*. For example, when more pieces of sheet paper P pass the center area of the heat roller 20 compared with both the sides thereof, it is also possible to set an output of the first induction current generating coil 50*a* larger than an output of the second induction current generating coil 50*b*.

The first and second induction current generating coils 50*a* and 50*b* have a shape substantially coaxial with the heat roller 20 and are formed by winding a wire around a magnetic core 52 for focused magnetic fluxes on the heat roller 20. As the wire, for example, a Litz wire formed by binding plural copper wires coated with heat resistant polyamide-imide and insulated from one another is used. By using the Litz wire as the wire, a diameter of the wire can be set smaller than the depth of penetration of a magnetic field. Consequently, it is possible to effectively feed a high-frequency current to the wire. In this embodiment, the Litz wire is formed by binding nineteen copper wires having a diameter of 0.5 mm.

When a predetermined high-frequency current is supplied to such a Litz wire, the first and second induction current generating coils 50*a* and 50*b* generate a magnetic flux. With this magnetic flux, the first and second induction current generating coils 50*a* and 50*b* generate an eddy-current in the metal layer 20*c* to prevent a magnetic field from changing. Joule heat is generated by this eddy-current and a resistance of the metal layer 20*c* and the heat roller 20 is instantaneously heated.

As the first and second thermistors 56*a* and 56*b* not in contact with the heat roller 20, for example, infrared temperature sensors of a thermopile type are used. The infrared temperature sensors of the thermopile type receive infrared rays, calculate infrared energy, and detect a temperature change in a thermocouple contact generated in thermopiles as startup power of a thermocouple. The first thermistor 56*a* detects the surface temperature substantially in the center of the heat roller 20 in a non-contact manner and converts the surface temperature into a voltage.

The second thermistor 56*b* includes a compound-eye type thermistor that is capable of detecting temperatures in plural places. The second thermistor 56*b* detects the surface temperature on a side of the heat roller 20 and the surface temperature on one side (β1) of the non-paper passing areas in a non-contact manner at predetermined timings, respectively, and converts the surface temperatures into voltages.

When the second thermistor 56*b* detects the temperature on the surface of the metal conductive layer 20*c* is exposed on one side (β1) of the non-paper passing areas when the surface temperature of the heat roller 20 is 160° C., the second thermistor 56*b* outputs, for example, a voltage of +1.25 V. When the second thermistor 56*b* detects the temperature on the surface of the silicon rubber layer 20*d* is exposed on one side (β1) of the non-paper passing areas when the surface temperature of the heat roller 20 is 160° C., the second thermistor 56*b* outputs, for example, a voltage of +2.35 V. However when the surface temperature of the heat roller 20 is the room temperature (30° C.), the second thermistor 56*b* detects the temperatures on the surface where the metal conductive layer 20*c* is exposed and the silicon rubber layer 20*d* is exposed on one side (β1) of the non-paper passing areas, the second thermistor 56*b* outputs, same voltages of +1.25V for example. That is to say, when the heat roller 20 which is heated is rotating and the second thermistor 56*b* detects the temperature on one side (β1) of the non-paper passing area, a voltage outputted from the second thermistor 56*b* has a difference of about 1.1 V between the exposed surface of the metal conductive layer 20*c* and the exposed surface of the silicon rubber layer 20*d*.

Instead of the compound-eye type second thermistor 56*b*, a single-eye type thermistor that detects the surface temperature on the side of the heat roller 20 and a single-eye type thermistor that detects the surface temperature on one side (β1) of the non-paper passing areas respectively may be used.

The first thermostat 57*a* detects trouble in the surface temperature in the center of the heat roller 20. The second thermostat 57*b* detects trouble in the surface temperature on the side of the heat roller 20. When the first or second thermostat 57*a* or 57*b* detects the trouble, the first or second thermostat 57*a* or 57*b* forcibly turns off the supply of electric power to the first and second induction current generating coils 50*a* and 50*b*.

Figure 6:
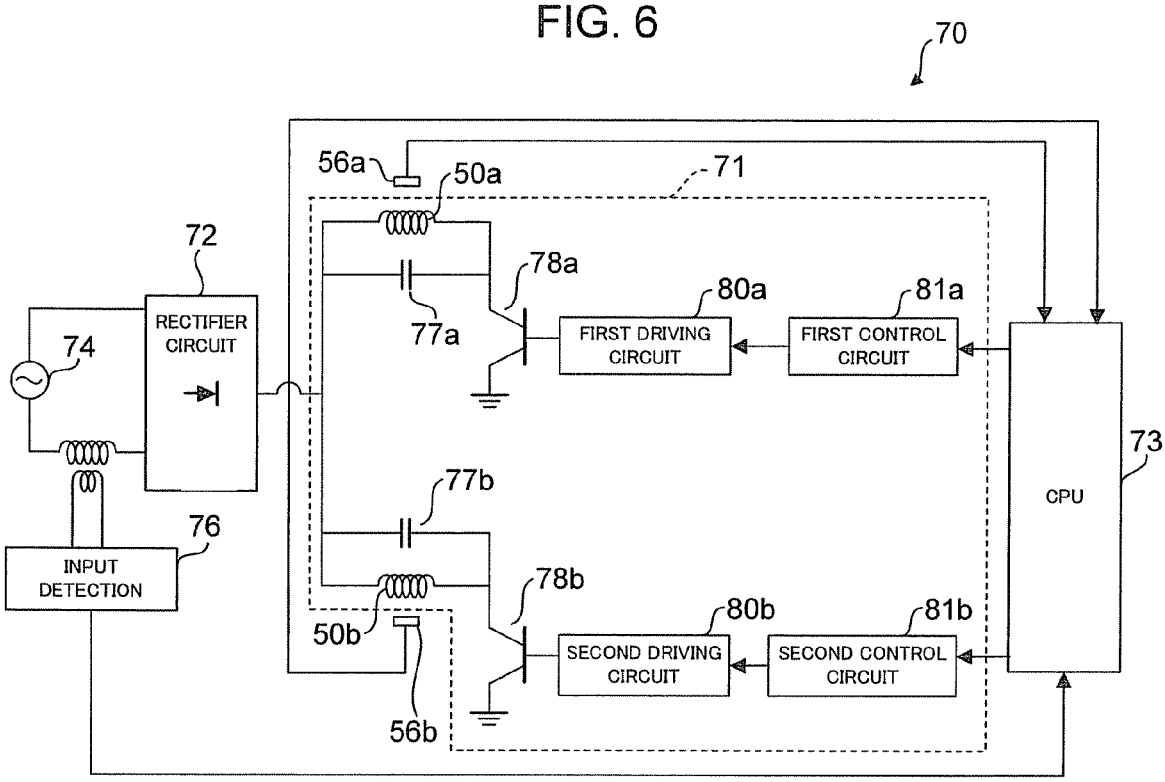
FIG. 6 is a schematic circuit diagram showing a control system that performs temperature control and rotation detection for the heat roller according to the embodiment.

A control system 70 that performs temperature control and rotation detection for the heat roller 20 is described. As shown in a circuit diagram in FIG. 6, the control system 70 includes an inverter driving circuit 71 that supplies electric power to the first and second induction current generating coils 50*a* and 50*b*, a rectifier circuit 72 that supplies 100 V DC power to the inverter driving circuit 71, and a CPU 73 that controls the entire image forming apparatus 1 and controls the inverter driving circuit 71 according to detection results of the first and second thermistors 56*a* and 56*b*.

The CPU 73 detects a rotation state of the heat roller 20 according to a detection result of the second thermistor 56*b*. The CPU 73 controls the inverter driving circuit 71 according to the detected rotation state of the heat roller 20. The CPU 73 may control the inverter driving circuit 71 to drive one of the first induction current generating coil 50*a* and the second induction current generating coil 50*b* to output electric power. Alternatively, the CPU 73 may simultaneously drive both the first and second induction current generating coils 50*a* and 50*b*.

The rectifier circuit 72 is a rectifier circuit for 100 V. The rectifier circuit 72 rectifies an electric current from an AC commercial power supply 74 into a direct current of 100 V and supplies the direct current to the inverter driving circuit 71. An input detection circuit 76 is connected between the rectifier circuit 72 and the commercial power supply 74. The input detection circuit 76 detects electric power supplied from the commercial power supply 72 and feeds back the detection to the CPU 73. A first capacitor 77*a* for resonance is connected to the inverter driving circuit 71 in parallel to the first induction current generating coil 50*a* to form a resonant circuit. A second capacitor 77*b* for resonance is connected to the inverter driving circuit 71 in parallel to the second induction current generating coil 50*b* to form a resonant circuit.

First and second switching elements 78*a* and 78*b* are connected to the resonant circuits in series, respectively. First and second driving circuits 80*a* and 80*b* for turning on the first and second switching elements 78*a* and 78*b*, respectively, are connected to control terminals of the first and second switching elements 78*a* and 78*b*, respectively. The first and second control circuits 81*a* and 81*b* are controlled by the CPU 73 and control application timing of the first and second driving circuits 80*a* and 80*b*. The inverter driving circuit 71 controls on-time of the first and second switching elements 78*a* and 78*b* using the CPU 73 to thereby vary a frequency. Electric power values to the first and second induction current generating coils 50*a* and 50*b* are controlled according to fluctuation in a frequency of a driving current.

Figure 7:
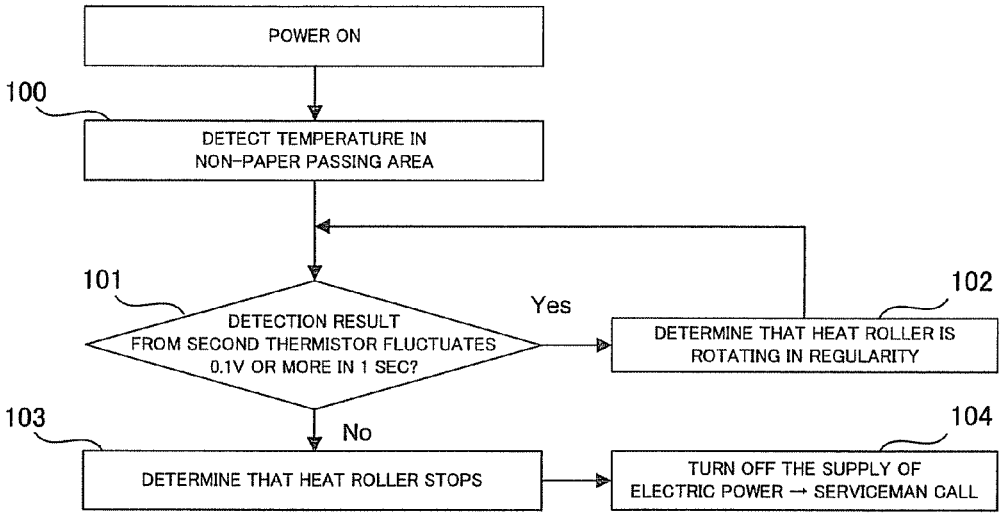
FIG. 7 is a flowchart showing rotation detection for the heat roller according to the embodiment.

The rotation detection for the heat roller 20 by the CPU 73 is described with reference to a flowchart in FIG. 7. When the heat roller 20 is rotated, the rotation detection for the heat roller 20 is always carried out. The rotation of the heat roller 20 is performed in a warm-up mode, a print mode, a standby mode (the image forming apparatus 1 keeps the surface temperature of the heat roller 20 at predetermined fixing temperature and, when a print instruction is received, immediately stands by in a printable state), a preheating mode (the image forming apparatus 1 keeps the surface temperature of the heat roller 20 at predetermined preheating temperature lower than the fixing temperature and, when a print instruction is received, immediately raises the surface temperature of the heat roller 20 to the printable fixing temperature) or the like of the image forming apparatus 1.

For example, when a power supply for the image forming apparatus 1 is turned on to start warm-up, the CPU 73 controls driving of the fixing motor 36 and controls the inverter driving circuit 71. Consequently, the heat roller 20 starts rotation in an arrow "s" direction. The first and second induction current generating coils 50*a* and 50*b* are supplied with electric power to start heat generation for the entire length of the heat roller 20. During this warm-up, the first and second thermistors 56*a* and 56*b* perform temperature detection in the paper passing area (α) of the heat roller 20 at intervals of, for example, 90 mmsec and input temperature detection values to the CPU 73. The CPU 73 feedback-controls, on the basis of the detection values in the paper passing area (α) from the first and second thermistors 56*a* and 56*b*, the supply of electric power to the first and second induction current generating coils 50*a* and 50*b*.

At the same time, the compound-eye type second thermistor 56*b* detects the temperature on one side (β1) of the non-paper passing areas and inputs a detection result to the CPU 73 (step 100). The second thermistor 56*b* alternately detects the temperature in the paper passing area (α) and the non-paper passing area (β1) at predetermined timing.

Subsequently, the CPU 73 determines, from the detection result on one side (β1) of the non-paper passing area by the second thermistor 56*b*, whether output fluctuation of a predetermined amount has occurred in a predetermined time (step 101). For example, in step 101, the CPU 73 determines, from the detection result from the second thermistor 56*b*, whether an output has fluctuated by, for example, 0.1 V or more in 1 sec. When the heat roller 20 is rotating, if the temperature of the heat roller 20 is heated from 30° C. to 60° C., a difference in the detection result by the second thermistor 56*b* is about 1.4 V between the exposed surface of the metal conductive layer 20*c* and the exposed surface of the silicon rubber layer 20*d*. Therefore, when fluctuation in an output from the second thermistor 56*b* is equal to or larger than 1 V while the predetermined time elapses, the CPU 73 determines that the heat roller 20 is rotating (when fluctuation in an output from the second thermistor 56*b* is smaller than 0.1 V while the predetermined time elapses, the CPU 73 determines that the heat roller 20 is not rotating).

Figure 8:
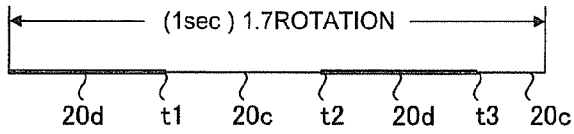
FIG. 8 is a schematic explanatory diagram showing a rotation state per one second on one side of the non-paper passing areas of the heat roller according to the embodiment.

This predetermined time is not limited. However, for example, when a diameter of the heat roller 20 is 50 mm and circumferential speed of the heat roller 20 is 270 mm/sec, the heat roller 20 rotates about 1.7 times in 1 sec. Consequently, on one side (β1) of the non-paper passing areas of the heat roller 20, in 1 sec, the exposed surface of the metal conductive layer 20*c* and the exposed surface of the silicon rubber layer 20*d* traveling in a detection position of the second thermistor 56*b* change as shown in FIG. 8. Therefore, when the heat roller 20 is normally rotating, on one side (β1) of the non-paper passing areas, fluctuation of about 0.1 V occurs at least three times at t1, t2, and t3 in 1 sec in detection results outputted from the second thermistor 56*b*. Consequently, for example, when output fluctuation in the second thermistor

56*b* is equal to or larger than 0.1 V while 1 sec elapses, the CPU 73 determines that the heat roller 20 is rotating. In other words, even if 1 sec elapses because of breakage of the metal belt 22, a deficiency of the fixing motor 36, or the like, when output fluctuation in the second thermistor 56 is smaller than 0.1 V, the CPU 73 determines that the heat roller 20 is not rotating.

Therefore, when an output of a temperature detection value on one side (β1) of the non-paper passing areas fluctuates 0.1 V or more in 1 sec in step 101, the CPU 73 proceeds to step 102 and determines that the heat roller 20 is normally rotating. Thereafter, the CPU 73 returns to step 101 and continues the detection of a rotation state of the heat roller 20 at the predetermined timing. On the other hand, when an output of a temperature detection value on one side (β1) of the non-paper passing areas does not fluctuate 0.1 V or more in 1 sec in step 101, the CPU 73 proceeds to step 103 and determines that the heat roller 20 is not rotating. Subsequently, the CPU 73 proceeds to step 104, turns off the supply of electric power to the first and second induction current generating coils 50*a* and 50*b*, and displays, for maintenance, serviceman call on, for example, a control panel of the image forming apparatus 1.

On the other hand, when the surface temperature of the heat roller 20 is controlled by the inverter driving circuit 71 to reach, for example, the fixable temperature of 160° C. and the warm-up is completed, the image forming apparatus 1 becomes into the standby mode. During the standby mode, in the fixing device 11, the first and second thermistors 56*a* and 56*b* detect the surface temperature in the paper passing area (α) of the heat roller 20 and feedback-control electric power supplied to the first and second induction current generating coils 50*a* and 50*b* to keep the fixable temperature. When the heat generation of the heat roller 20 is continued in this way, the foam silicon rubber layer 20*b* of the elastic roller 21 is heated and thermally expands. Consequently, in the heat roller 20, in a state in which the metal belt 22 tightens the elastic roller 21, the metal belt 22 and the elastic roller 21 fit in each other.

When printing is instructed after the warm-up is completed, the printer unit 2 starts print operation and forms a toner image on the sheet paper P in the image forming unit 10. Subsequently, the printer unit 2 inserts the sheet paper P having the toner image through the nip 37 between the heat roller 20 and the press roller 30 to heat, press, and fix the toner image. After fixing operation is finished, when there is no print instruction for a predetermined time, the image forming apparatus 1 becomes into the preheating mode. In these respective modes, the CPU 73 always detects a rotation state of the heat roller 20, using a temperature detection result on one side (β1) of the non-paper passing areas from the second thermistor 56*b*.

While the surface temperature of the heat roller 20 is feedback-controlled by the inverter driving circuit 71 in this way, when the inverter driving circuit 71 cannot be controlled because of a deficiency and the surface temperature of the heat roller 20 exceeds a threshold, the first or second thermostat 57*a* or 57*b* detects trouble and forcibly turns off the inverter driving circuit 71.

Thereafter, when the power supply for the image forming apparatus 1 is turned off, the foam silicon rubber layer 20*b* of the elastic roller 21 is cooled to shrink. When the temperature of the foam silicon rubber layer 20*b* falls to the room temperature (30° C.), the metal belt 22 becomes slidable with respect to the elastic roller 21. Therefore, when it is necessary to replace the metal belt 22, the used metal belt 22 is removed from the elastic roller 21 and a new metal belt 22 is attached to the elastic roller 21 in use. This makes it possible to maintain satisfactory fixing performance and easily reuse the elastic roller 21. The replacement of the metal belt 22 is not limited to periodic replacement. The replacement of the metal belt 22 can be performed at any time, for example, when temperature detection on one side (β1) of the non-paper passing areas of the heat roller 20 is performed by the second thermistor 56*b* according to this embodiment and it is determined that the heat roller 20 is not rotating.

According to this embodiment, the non-paper passing area (β1) of the heat roller 20 is formed by the surface where the metal conducive layer 20*c* is exposed and the surface where the silicon rubber layer 20*d* is exposed. By detecting the temperature in the non-paper passing area (β1) with the second thermistor 56*b*, it is possible to detect a rotation state of the heat roller 20. Therefore, unlike the past, it is unnecessary to provide a new member in the heat roller 20. It is possible to accurately and quickly detect a rotation state of the heat generating member without being affected by, for example, fluctuation in a driving frequency of the induction current generating devices. As a result, it is possible to surely prevent overheat of the heat generating member and realize safety and extension of durable life of the fixing device.

The present invention is not limited to the embodiment described above and various modifications of the embodiment are possible within the scope of the present invention. For example, the structure of the fixing device is not limited. For example, the heat generating member or the opposed member may be formed in a belt shape. In the embodiment, the temperature on only one side of the non-paper passing area of the heat generating member is detected by the infrared temperature sensor. However, it is also possible that surfaces on which the metal layer is exposed and surfaces on which the coating layer is exposed are formed in the non-paper passing areas on both the sides of the heat generating member and the temperatures on both the sides of the non-paper passing area are detected by the infrared temperature sensor. A proportion or an arrangement-pattern of the metal layer and the coating layer in the non-paper passing areas of the heat generating member is not limited and may be any ratio or arrangement as long as a rotation state of the heat generating member is detectable.

In the embodiment, when fluctuation in an output of the infrared temperature sensor in the predetermined time is smaller than the predetermined value, it is judged that the heat generating member is not rotating. However, the determination about the rotation of the heat generating member is not limited to this. For example, it is also possible that a counter is provided in the control unit, detection timing of the non-paper passing areas by the infrared temperature sensor is counted, and, when fluctuation in an output of the infrared temperature sensor is smaller than the predetermined value even if the count reaches a predetermined count number, it is judged that the heat generating member is not rotating. The infrared temperature sensor that detects the temperature of the non-paper passing areas may be a single-eye type infrared temperature sensor.

What is claimed is:

1. A drive detection device for a fixing device comprising:

a heat generating member that has a metal layer to be induction-heated, an entire surface of the metal layer being coated with a coating layer in a paper passing area, and has, in a non-paper passing area, a surface where the metal layer is exposed and a surface where the coating layer is exposed;

an induction current generating device that induction-heats the metal layer;

a driving source that rotates the heat generating member;

an infrared temperature sensor that detects surface temperature in the non-paper passing area of the heat generating member; and a control unit configured to determine a rotation state of the heat generating member according to a detection result of the infrared temperature sensor.

2. A drive detection device for a fixing device according to claim 1, wherein infrared radiant energy on the metal layer and infrared radiant energy on the coating layer are different.

3. A drive detection device for a fixing device according to claim 1, wherein the infrared temperature sensor detects temperature of the non-paper passing area at predetermined timing.

4. A drive detection device for a fixing device according to claim 3, wherein the control unit determines, when the infrared temperature sensor obtains both a detection result of temperature on the surface where the coating layer is exposed of the non-paper passing area and a detection result of temperature on the surface where the metal layer is exposed of the non-paper passing area, that the heat generating member is rotating.

5. A drive detection device for a fixing device according to claim 4, wherein the control unit determines, when the detection results obtained by the infrared temperature sensor fluctuate by a predetermined amount in a predetermined time, that the heat generating member is rotating.

6. A drive detection device for a fixing device according to claim 1, wherein length of the surface where the metal layer is exposed and length of the surface where the coating layer is exposed in a rotating direction of the non-paper passing area of the heat generating member are the same.

7. A drive detection device for a fixing device according to claim 1, wherein the heat generating member includes a metal belt that has the metal layer, and an elastic roller that has an elastic layer arranged on an inner side of the metal belt.

8. A drive detection device for a fixing device according to claim 7, wherein the metal belt is slidable with respect to the elastic roller.

9. A drive detection device for a fixing device according to claim 8, further comprising an opposed member that is opposed to the elastic roller via the metal belt and nips the metal belt in cooperation with the elastic roller, wherein the driving source drives at least one of the elastic roller and the opposed member to rotate the heat generating member.

10. A drive detection device for a fixing device according to claim 7, wherein the metal belt has, in the paper passing area, the coating layer on an outer side of the metal layer and has a surface layer on an outer side of the coating layer.

11. A drive detection device for a fixing device according to claim 7, wherein the induction current generating device is an induction current generating coil provided on an outer circumference of the metal belt.

12. A drive detection device for a fixing device according to claim 1, wherein, when the control unit determines that the heat generating member is not rotating, the control unit turns off supply of electric power to the induction current generating device.

13. A drive detection method for a fixing device comprising:

forming a surface where a metal layer is exposed and a surface where the metal layer is coated with a coating layer, in a non-paper passing area of a heat generating member having a metal layer to be induction-heated;

driving a driving source for rotating the heat generating member;

detecting surface temperature of the non-paper passing area of the heat generating member with an infrared temperature sensor; and determining a rotation state of the heat generating member according to a detection result of the infrared temperature sensor.

14. A drive detection method for a fixing device according to claim 13, wherein infrared radiant energy on the metal layer and infrared radiant energy on the coating layer are different.

15. A drive detection method for a fixing device according to claim 13, further comprising turning off supply of electric power to an induction current generating device that induction-heats the metal layer, when it is determined that the heat generating member is not rotating.

16. A drive detection method for a fixing device according to claim 13, wherein the infrared temperature sensor detects temperature of the non-paper passing area at predetermined timing.

17. A drive detection method for a fixing device according to claim 16, further comprising determining that the heat generating member is rotating, when the infrared temperature sensor obtains both a detection result of temperature on the surface where the coating layer is exposed of the non-paper passing area and a detection result of temperature on the surface where the metal layer is exposed of the non-paper passing area.

18. A drive detection method for a fixing device according to claim 17, further comprising determining that the heat generating member is rotating, when the detection results obtained by the infrared temperature sensor fluctuate by a predetermined amount in a predetermined time.

19. A drive detection method for a fixing device according to claim 13, further comprising forming the surface where the metal layer is exposed and the surface where the coating layer is exposed in a rotating direction of the non-paper passing area of the heat generating member to have same length.

20. A drive detection method for a fixing device according to claim 13, further comprising induction-heating the metal layer with an induction current generating device provided on an outer circumference of the heat generating member.

* * * * *